US009975735B2

(12) United States Patent
Roberts et al.

(10) Patent No.: US 9,975,735 B2
(45) Date of Patent: May 22, 2018

(54) CAB ISOLATION OF AN ELEVATOR CAR

(71) Applicant: OTIS ELEVATOR COMPANY, Farmington, CT (US)

(72) Inventors: Randall Roberts, Hebron, CT (US); Richard N. Fargo, Plainville, CT (US); Walter Thomas Schmidt, Marlborough, CT (US); YiSug Kwon, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days. days.

(21) Appl. No.: 15/254,435

(22) Filed: Sep. 1, 2016

(65) Prior Publication Data

US 2017/0057790 A1 Mar. 2, 2017

Related U.S. Application Data

(60) Provisional application No. 62/212,815, filed on Sep. 1, 2015.

(51) Int. Cl.

| | |
|---|---|
| ***B66B 7/06*** | (2006.01) |
| ***B66B 9/00*** | (2006.01) |
| ***B66B 11/02*** | (2006.01) |

(52) U.S. Cl.

CPC ..... *B66B 11/0273* (2013.01); *B66B 9/003* (2013.01)

(58) Field of Classification Search

CPC . B66B 11/0273; B66B 9/003; B66B 11/0213; B66B 11/005

See application file for complete search history.

(56) References Cited

U.S. PATENT DOCUMENTS

| | | | | |
|---|---|---|---|---|
| 4,865,157 | A * | 9/1989 | Sissala | B66B 11/0273 187/410 |
| 5,141,082 | A | 8/1992 | Ishii et al. | |
| 5,325,937 | A | 7/1994 | Suchodolski et al. | |
| 5,464,072 | A | 11/1995 | Muller | |
| 5,501,295 | A | 3/1996 | Muller et al. | |
| 5,896,949 | A | 4/1999 | Hamdy et al. | |
| 5,960,910 | A * | 10/1999 | Traktovenko | B66B 11/0273 187/401 |
| 6,435,314 | B1 * | 8/2002 | Bledsoe | B66B 11/0273 187/292 |
| 6,668,980 | B2 | 12/2003 | Smith | |
| 6,786,304 | B2 * | 9/2004 | Utsunomiya | B66B 7/046 187/292 |
| 7,017,714 | B2 * | 3/2006 | Fujita | B66B 1/425 187/267 |
| 7,261,186 | B2 * | 8/2007 | Deplazes | B60L 13/10 187/277 |
| 7,810,611 | B2 | 10/2010 | Zeng et al. | |

(Continued)

FOREIGN PATENT DOCUMENTS

| | | |
|---|---|---|
| WO | 2014158127 A1 | 10/2014 |
| WO | 2015084367 A1 | 6/2015 |

*Primary Examiner* — William E Dondero
*Assistant Examiner* — Diem M Tran
(74) *Attorney, Agent, or Firm* — Cantor Colburn LLP

(57) ABSTRACT

An elevator car is constructed and arranged to move along a hoistway. The car includes a cab support from below by a platform. A vertical member is connected to the platform via a flex joint and extends upward from platform for further elevator cab support. The flex joint facilitates cab isolation from vibration and noise.

19 Claims, 5 Drawing Sheets

(56) References Cited

U.S. PATENT DOCUMENTS

| | | | | |
|---|---|---|---|---|
| 8,960,377 | B2 | 2/2015 | Zhang | |
| 2002/0179377 | A1* | 12/2002 | Higaki | B66B 7/044 187/292 |
| 2006/0163008 | A1 | 7/2006 | Godwin | |
| 2012/0048658 | A1 | 3/2012 | Brugger et al. | |
| 2012/0152657 | A1* | 6/2012 | Husmann | B66B 1/425 187/249 |

* cited by examiner

CAB ISOLATION OF AN ELEVATOR CAR

CROSS REFERENCE TO RELATED APPLICATION

This application claims priority to U.S. Provisional Patent Application No. 62/212,815, filed Sep. 1, 2015, the entire contents of which is incorporated herein by reference.

BACKGROUND

The present disclosure relates to elevator systems, and more particularly to cab isolation of an elevator car.

Self-propelled elevator systems, also referred to as ropeless elevator systems, are useful in certain applications (e.g., high rise buildings) where the mass of the ropes for a roped system is prohibitive and/or there is a need for multiple elevator cars in a single hoistway. Elevator cars typically include a cab and a carriage that supports and moves with the cab. The elevator system may further include multiple thrust producing actuators that are electromagnetically coupled to guidance and propulsion devices in the hoistway that may have relative misalignments. It is desirable for the cab-supporting carriage to accommodate such misalignments. It may further desirable to mechanically isolate the cab from noise and vibration that may be transmitted by or through the carriage and to the cab for ride comfort and/or propulsion efficiency.

SUMMARY

An elevator car constructed and arranged to move along a hoistway, the elevator car according to one, non-limiting, embodiment of the present disclosure including a cab; a platform disposed below the cab; a first vertical member extending upward from the platform; and a first flex joint connected to and extending between the platform and the first vertical member.

Additionally to the foregoing embodiment, the elevator car includes a first isolator connected to and extending between the platform and the cab.

In the alternative or additionally thereto, in the foregoing embodiment, the elevator car includes a second isolator connected to and extending between the first vertical member and the cab.

In the alternative or additionally thereto, in the foregoing embodiment, the elevator car includes a second isolator connected to and extending between the first vertical member and a first side of the cab, and wherein the second isolator is proximate to a top of the cab.

In the alternative or additionally thereto, in the foregoing embodiment, the elevator car includes a crosshead member disposed above and extending over the cab; and a second flex joint connected to and extending between the first vertical member and the crosshead member.

In the alternative or additionally thereto, in the foregoing embodiment, the elevator car includes a first guide device supported by the first vertical member for guiding the elevator car within the hoistway.

In the alternative or additionally thereto, in the foregoing embodiment, the first guide device is at least one roller.

In the alternative or additionally thereto, in the foregoing embodiment, the elevator car includes a second vertical member with the first vertical member disposed adjacent to a first side of the cab and the second vertical member disposed adjacent to an opposite second side of the cab; and a third flex joint connected to and extending between the platform and the second vertical member.

In the alternative or additionally thereto, in the foregoing embodiment, the elevator car includes a fourth flex joint connected to and extending between the second vertical member and the crosshead member.

In the alternative or additionally thereto, in the foregoing embodiment, the elevator car includes a first isolator connected to and extending between the platform and the cab; a second isolator connected to and extending between the first vertical member and the cab; and a third isolator connected to and extending between the second vertical member and the cab.

In the alternative or additionally thereto, in the foregoing embodiment, at least one of the first, second and third isolators is a spring.

In the alternative or additionally thereto, in the foregoing embodiment, at least one of the first, second and third isolators is a resilient puck.

In the alternative or additionally thereto, in the foregoing embodiment, the second and third isolators are proximate to a top of the cab.

In the alternative or additionally thereto, in the foregoing embodiment, the elevator car includes a first plurality of permanent magnets engaged to and distributed along the first vertical member for elevator car propulsion; and a second plurality of permanent magnets engaged to and distributed along the second vertical member for elevator car propulsion.

In the alternative or additionally thereto, in the foregoing embodiment, the elevator car includes a first guide device supported by the first vertical member for guiding the elevator car within the hoistway; and a second guide device supported by the second vertical member for guiding the elevator car within the hoistway.

In the alternative or additionally thereto, in the foregoing embodiment, the elevator car is a ropeless elevator car.

In the alternative or additionally thereto, in the foregoing embodiment, the flex joints have two degrees of freedom including a translational direction and a rotational direction.

In the alternative or additionally thereto, in the foregoing embodiment, the translational direction and the rotational directions are orientated within a common imaginary plane.

In the alternative or additionally thereto, in the foregoing embodiment each flex joint includes at least one stopper for limiting translational motion and at least one snubber for limiting rotational motion.

In the alternative or additionally thereto, in the foregoing embodiment, the first flex joint includes a casing engaged to one of the platform and the vertical member, a piston head arranged to reciprocate in a bore defined by the casing, and a shaft pivotally engaged between the piston head and the other of the platform and the vertical member.

A ropeless elevator system according to another, non-limiting, embodiment includes an elevator car constructed and arranged to move along a hoistway, the elevator car including a cab, a platform disposed beneath the cab, a vertical member extending upward from the platform and a first flex joint engaged between the platform and the vertical member for flexing of the platform with respect to the vertical member; and a linear propulsion system carried between the hoistway and the vertical member for propelling the elevator car.

Additionally to the foregoing embodiment, the elevator car includes a first isolator extending between the platform and the cab for attenuating energy.

In the alternative or additionally thereto, in the foregoing embodiment, the elevator car includes a cross head member extending over the cab, and a second flex joint engaged between the vertical member and the crosshead member.

In the alternative or additionally thereto, in the foregoing embodiment, the elevator car includes a second isolator extending between the vertical member and the cab.

In the alternative or additionally thereto, in the foregoing embodiment, the first flex joint has a non-linear force profile.

The foregoing features and elements may be combined in various combinations without exclusivity, unless expressly indicated otherwise. These features and elements as well as the operation thereof will become more apparent in light of the following description and the accompanying drawings. However, it should be understood that the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
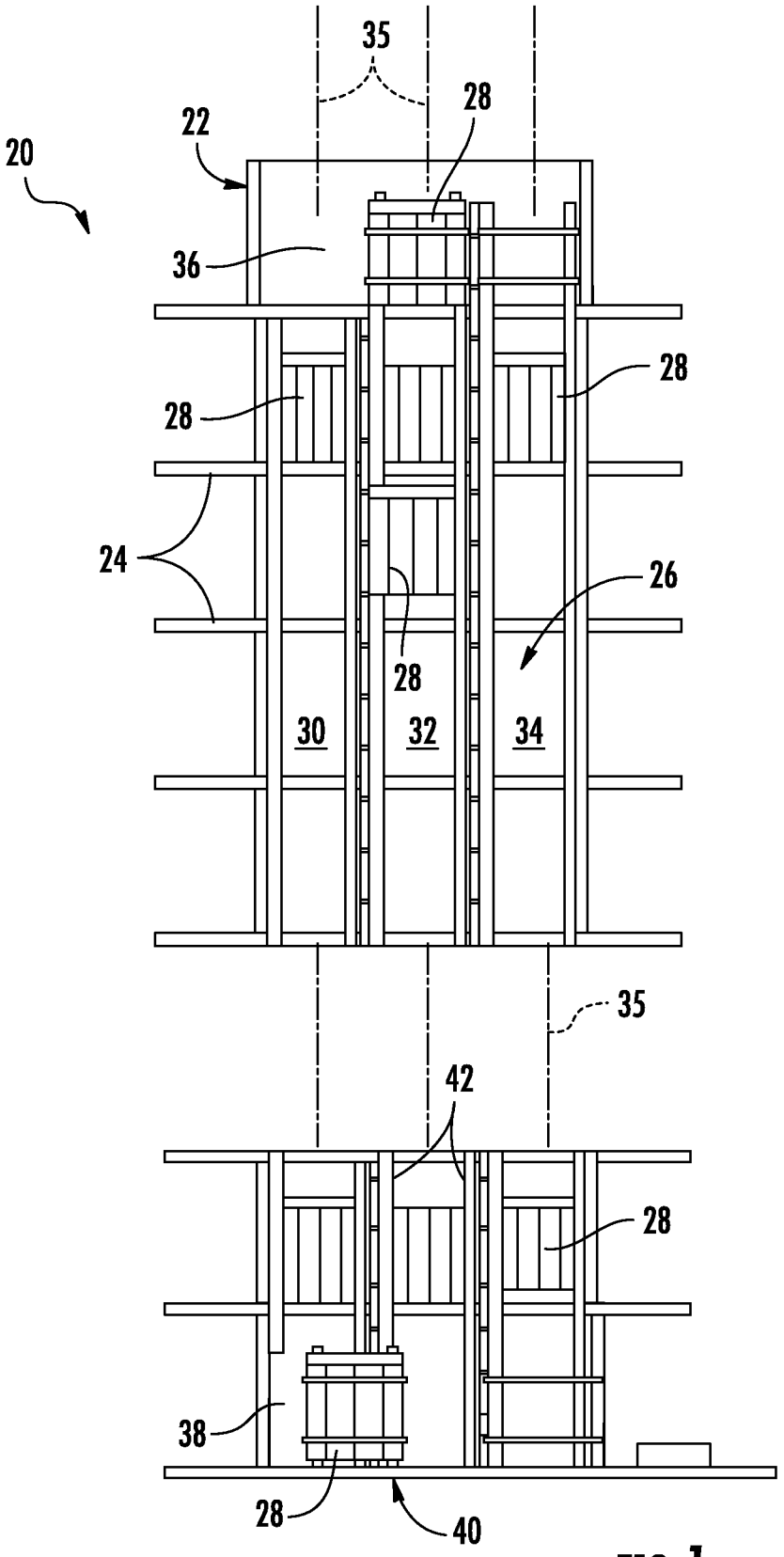
FIG. 1 depicts a multicar elevator system in an exemplary embodiment.

FIG. 1 depicts a self-propelled or ropeless elevator system 20 in an exemplary embodiment that may be used in a structure or building 22 having multiple levels or floors 24. Elevator system 20 includes a hoistway 26 having boundaries defined by the structure 22 and at least one car 28 adapted to travel in the hoistway 26. The hoistway 26 may include, for example, three lanes 30, 32, 34 each extending along a respective centerline 35 with any number of cars 28 traveling in any one lane and in any number of travel directions (i.e., up and down in the lanes and horizontally along centerline 35 in the transfer stations 36, 38). For example and as illustrated, the cars 28 in lanes 30, 34, may travel in an up direction and the cars 28 in lane 32 may travel in a down direction.

Above the top floor 24 may be an upper transfer station 36 that facilitates horizontal motion to elevator cars 28 for moving the cars between lanes 30, 32, 34. Below the first floor 24 may be a lower transfer station 38 that facilitates horizontal motion to elevator cars 28 for moving the cars between lanes 30, 32, 34. It is understood that the upper and lower transfer stations 36, 38 may be respectively located at the top and first floors 24 rather than above and below the top and first floors, or may be located at any intermediate floor. Yet further, the elevator system 20 may include one or more intermediate transfer stations (not illustrated) located vertically between and similar to the upper and lower transfer stations 36, 38.

Figure 2:
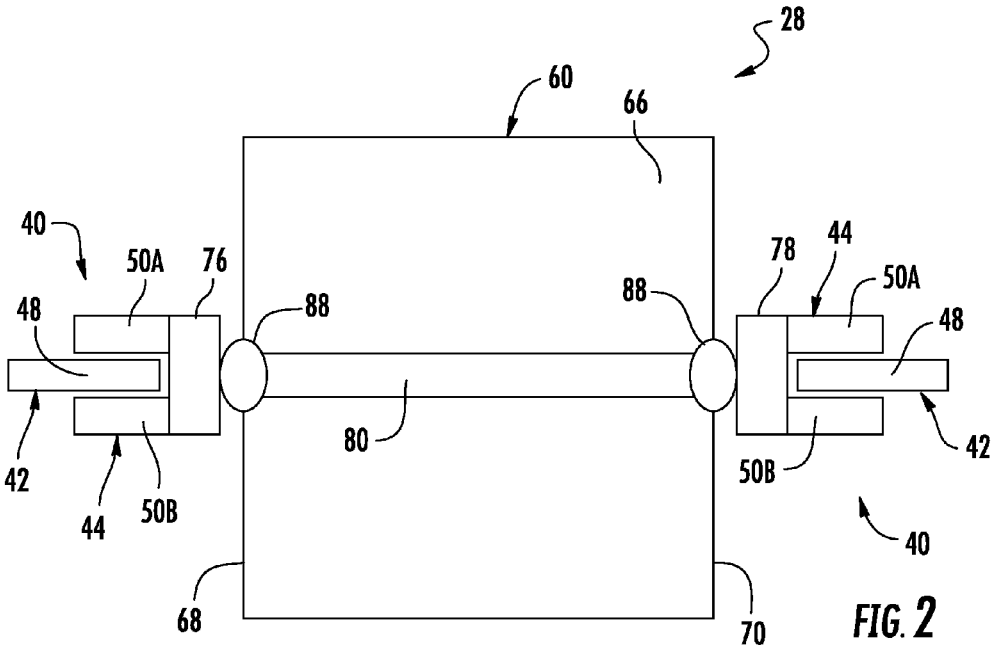
FIG. 2 is a top down view of an elevator car and portions of a linear propulsion system in an exemplary embodiment.
Figure 3:
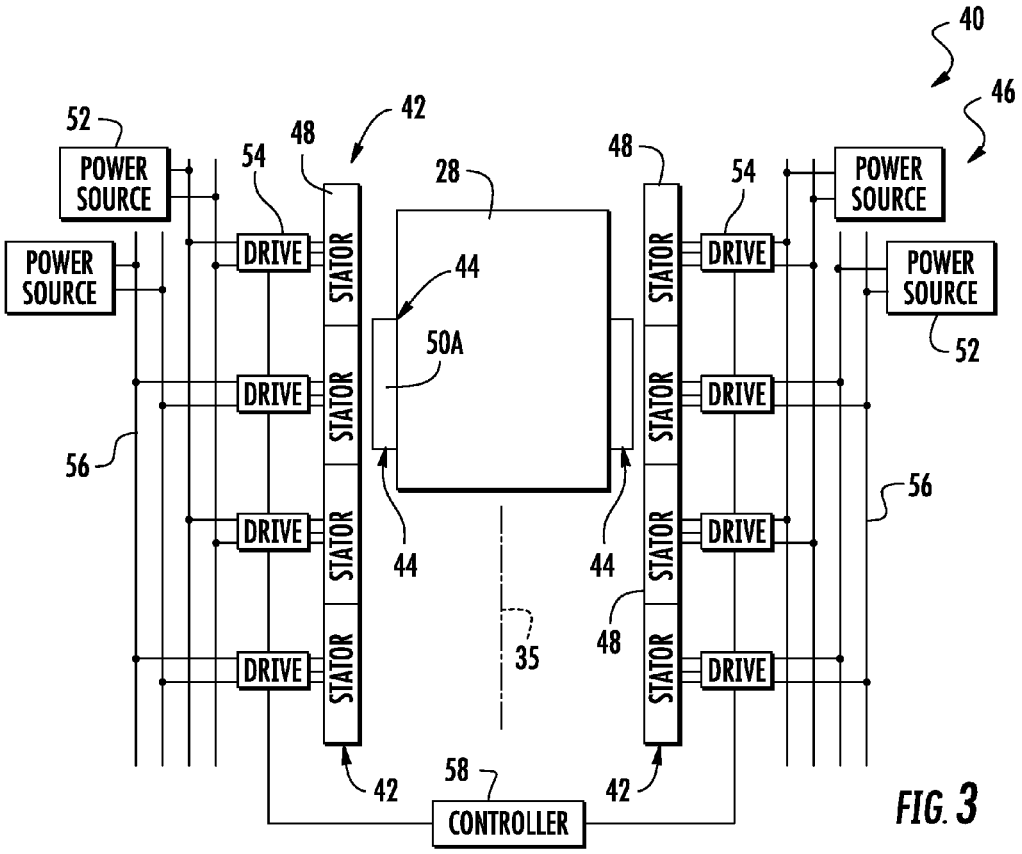
FIG. 3 is a schematic of the linear propulsion system.
Figure 4:
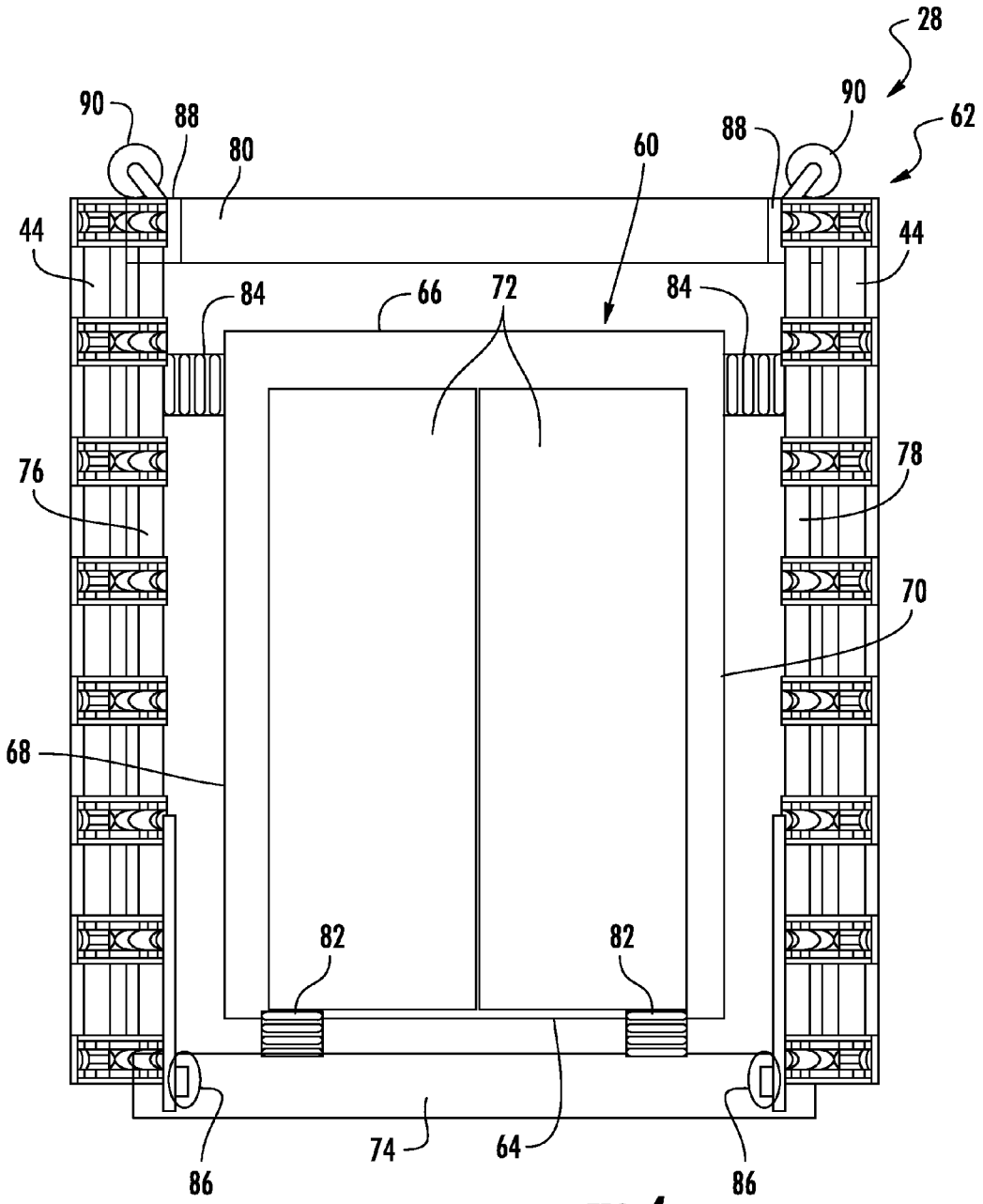
FIG. 4 is a side view of the elevator car.

Referring to FIGS. 1 through 3, cars 28 are propelled using a linear propulsion system 40 having at least one, fixed, primary portion 42 (e.g., two illustrated in FIG. 2 mounted on opposite sides of the car 28), moving secondary portions 44 (e.g., two illustrated in FIG. 2 mounted on opposite sides of the car 28), and a control system 46 (see FIG. 4). The primary portion 42 includes a plurality of windings or coils 48 mounted at one or both sides of the lanes 30, 32, 34 in the hoistway 26. Each secondary portion 44 may include two rows of opposing permanent magnets 50A, 50B mounted to the car 28. Primary portion 42 is supplied with drive signals from the control system 46 to generate a magnetic flux that imparts a force on the secondary portions 44 to control movement of the cars 28 in their respective lanes 30, 32, 34 (e.g., moving up, down, or holding still). The plurality of coils 48 of the primary portion 42 are generally located between and spaced from the opposing rows of permanent magnets 50A, 50B. It is contemplated and understood that any number of secondary portions 44 may be mounted to the car 28, and any number of primary portions 42 may be associated with the secondary portions 44 in any number of configurations.

Referring to FIG. 3, the control system 46 may include power sources 52, drives 54, buses 56 and a controller 58. The power sources 52 are electrically coupled to the drives 54 via the buses 56. In one non-limiting example, the power sources 52 may be direct current (DC) power sources. DC power sources 52 may be implemented using storage devices (e.g., batteries, capacitors), and may be active devices that condition power from another source (e.g., rectifiers). The drives 54 may receive DC power from the buses 56 and may provide drive signals to the primary portions 42 of the linear propulsion system 40. Each drive 54 may be a converter that converts DC power from bus 56 to a multiphase (e.g., three phase) drive signal provided to a respective section of the primary portions 42. The primary portion 42 is divided into a plurality of modules or sections, with each section associated with a respective drive 54.

The controller 58 provides control signals to each of the drives 54 to control generation of the drive signals. Controller 58 may use pulse width modulation (PWM) control signals to control generation of the drive signals by drives 54. Controller 58 may be implemented using a processor-based device programmed to generate the control signals. The controller 58 may also be part of an elevator control system or elevator management system. Elements of the control system 46 may be implemented in a single, integrated module, and/or be distributed along the hoistway 26.

Referring to FIGS. 2 and 4, the elevator car 28 may include a cab 60 supported by a carriage 62. The cab 60 includes a bottom 64, a top 66 and opposite sides 68, 70 with cab doors 72 located there-between. The carriage 62 may include a platform 74 located beneath the bottom 64 of the cab 60, a first substantially vertical member 76 projecting upward from the platform 74 and adjacent to the first side 68 of the cab 60, a second substantially vertical member 78 extending upward from the platform 74 and adjacent to the second side 70, and a crosshead member 80 located above the top 66 of the cab 60 and extending between the vertical members 76, 78.

The platform 74 may generally shadow the bottom 64 of the cab 60 (i.e., substantially square in shape like the bottom and about the same size or larger). A first plurality of isolators 82 of the carriage 62 may extend between and may be engaged to the bottom 64 of the cab 60 and the platform 74. Although two isolators 82 are illustrated in FIG. 4, any number of isolator 82 may extend between the platform 74 and the cab bottom 64. For example, there may be an isolator 82 generally located at each corner of the cab 60. Alternatively and depending upon the shape of the platform 74, there may be only two isolators 82 with each one proximate to the respective vertical members 76, 78. A second plurality of isolators 84 may extend between and may be engaged to the sides 68, 70 of the cab 60 and the respective vertical members 76, 78. The isolators 84 may further be located near or proximate to the top 66 of the cab 60.

The isolators 82, 84 are configured to isolate the cab 60 from the carriage 62 thereby minimizing or eliminating at least in-part the flow of acoustic energy into the cab. As non-limiting examples, the isolators 82, 84 may be springs, or, may be resilient pucks that may be made of a rubber-like material. Different types of isolators may be used at different locations depending upon a particular need and/or for accommodating flexibility at the specific location.

The carriage 62 may further include a first plurality of flex joints 86 (i.e., two illustrated in FIG. 4) extending between and connecting the vertical members 76, 78 to the platform 74. A second plurality of flex joints 88 (i.e. two illustrated in FIGS. 2 and 4) may generally connect the vertical members 76, 78 to respective opposite ends of the crosshead member 80. The flex joints 86, 88 facilitate limited and controlled motion between the platform 74 and members 76, 78, 80 while constraining other degrees of freedom to properly transmit desired forces. As non-limiting examples, the flex joints 86, 88 may be made of a bendable, resilient, and structurally sufficient material and/or may be mechanical devices that allow controlled translational and/or rotational motion between carriage components. Further examples of flex joints may include hinge-like devices, ball and socket joints, linear translational joints and others.

The carriage 62 may also include guide devices 90 that may be supported by each vertical member 76, 78 for, at least in-part, guiding the carriage 62 along the vertically extending primary portions 42 of the linear propulsion system 40. As one, non-limiting, example, the guide devices 90 may be rollers secured to the top and bottom ends of the vertical members 76, 78 (only the top shown in FIG. 4). It is further contemplated that such guide devices 90 may also be secured to the platform 74 and/or the crosshead member 80 or any combination thereof. The vertical members 76, 78 may also support the magnets 50A, 50B of the secondary portions 44 of the linear propulsion system 40. It is understood that the orientations of adjacent structures such as guide devices 90 and secondary portions 44, and the forces produced by the linear propulsion system 40 may impact the choice and locations of the flex joints 86, 88 and the isolators 82, 84.

Figure 5:
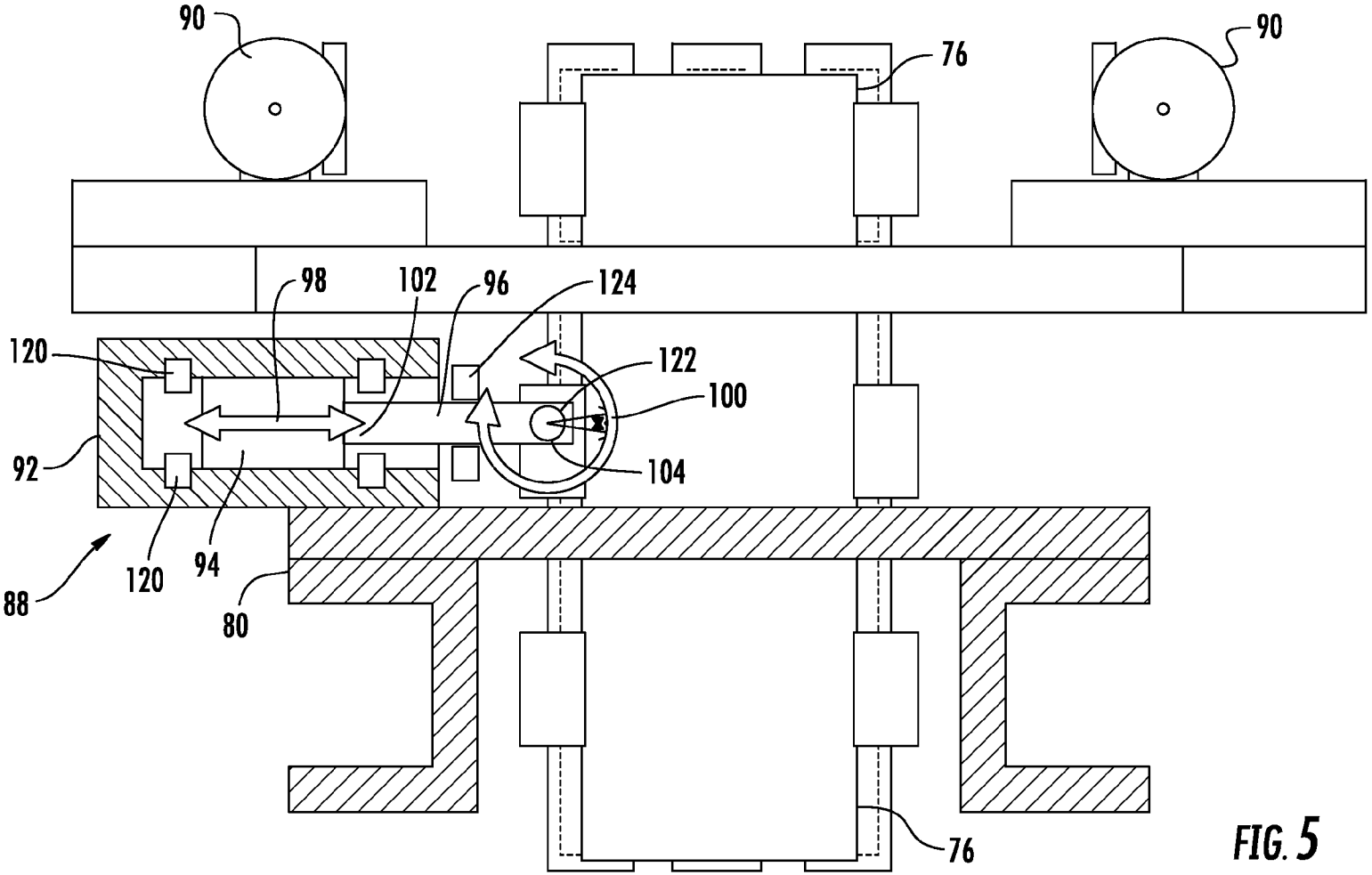
FIG. 5 is a cross section of an upper flex joint engaged between a crosshead member and a vertical member of the elevator car.

Referring to FIG. 5, a non-limiting example of the upper flex joint 88 may include a casing 92, a piston head 94, and a piston shaft 96 configured to facilitate two degrees of freedom between the crosshead member 80 and the vertical member 76 (see arrows 98, 100). The casing 92 may be rigidly engaged to the crosshead member 80 or other rigid structure engaged to the crosshead member. The piston head 94 is arranged to linearly translate within a bore defined by the casing 92, and opposite ends 102, 104 of the shaft 96 may be pivotally connected to the respective head 94 and the vertical member 76 (i.e., or other structure rigidly engaged to the vertical member).

Figure 6:
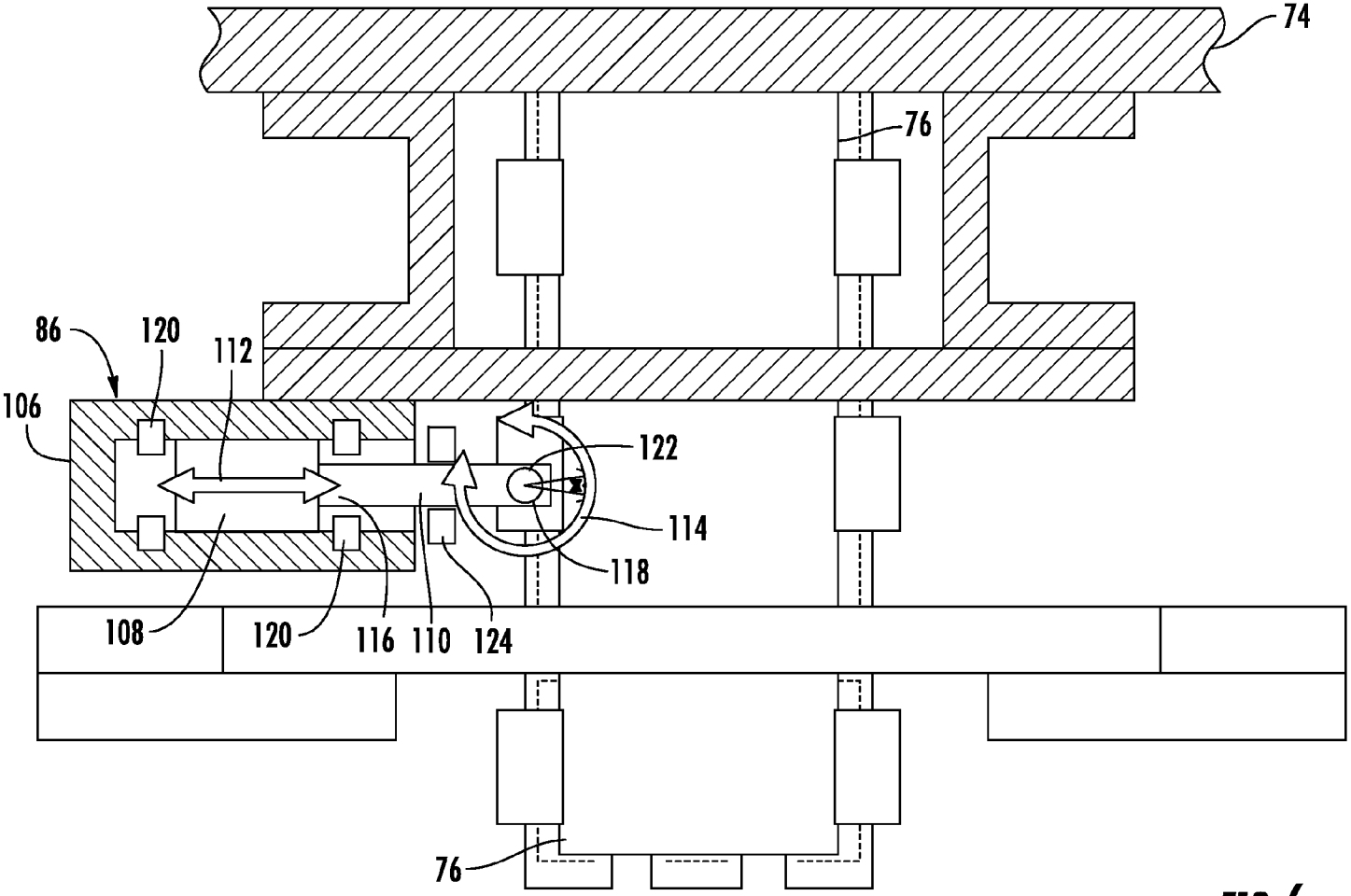
FIG. 6 is a cross section of a lower flex joint engaged between a platform and the vertical member of the elevator car.

Referring to FIG. 6, a non-limiting example of the lower flex joint 86 may include a casing 106, a piston head 108, and a piston shaft 110 configured to facilitate two degrees of freedom between the platform 74 and the vertical member 76 (see arrows 112, 114). The casing 106 may be rigidly engaged to the platform 74 or other rigid structure engaged to the platform. The piston head 108 is arranged to linearly translate within a bore defined by the casing 106, and opposite ends 116, 118 of the shaft 110 may be pivotally connected to the respective head 108 and the vertical member 76 (i.e., or other structure rigidly engaged to the vertical member).

In operation of the elevator car 28, the guide devices 90 may assist in maintaining two consistent gaps located, for example on both sides of the coils 48 of the primary portion 42, and respectively between the first permanent magnet 50A and the coil 48 for the first gap, and between the second permanent magnet 50B and the coil 48 for the second gap. As previously described, two primary portions 42 may be mounted on opposite sides of each lane 30, 32, 34. In instances where the opposing primary portions 42 are not aligned to one-another within preferred tolerances, excessive drag or restrictive forces may be placed on the guide devices 90 to maintain the consistent gaps. The flex joints 86, 88 may operate to eliminate or minimize excessive drag upon the guide devices 90 by facilitating multiple degrees of motion (two illustrated) between the vertical members 76, 78 and the platform 74 and crosshead member 80 of the carriage 62. That is, the carriage 62 is controllably capable of distortion and/or twisting to maintain consistent gaps and minimize drag upon the guide devices 90.

More specifically, the flex joints 86, 88 may be capable of two degrees of freedom which may include respective translational directions 98, 112 and rotational directions 100, 114. All directions 98, 100, 112, 114 may be substantially orientated along a common imaginary plane (not shown) that is substantially normal to the carriage 62. More specifically, the translational direction 98, 112 may be substantially parallel to one another and normal to the respective crosshead member 80 and platform 74. The rotational directions 100, 114 may generally be about the pivot axis where the respective shafts 96, 110 connect to the vertical members 76, 78. The axis of the flex joint degrees of freedom may be configured to minimize vibrational forces caused by guide rail installation alignment imperfections while also maintaining adequate structural rigidity as required by the propulsion system 40.

The flex joints 86, 88 may further have a tailored force verse deflection curve characterized by a low stiffness for small motions and a higher stiffness as the motion increases (i.e. a nonlinear force profile). As one, non-limiting, example, the translational stiffness may be achieved using a pneumatic cylinder to achieve the low stiffness in the flexibility region and hard stoppers 120 that restrict the amount of translational motion along directions 98, 112. As one, non-limiting, example, the rotational stiffness may be facilitated by a flexible revolute joint 122 with snubbers 124 that limit the amount of rotation. The flexing capability of the carriage 62 may be designed to be relatively small and may accommodate guide rail and primary misalignments in the lanes 30, 32, 34. For larger deflections the force levels may increase to accommodate potential severe operational loading conditions that may not be typical of normal running conditions.

While the present disclosure is described with reference to exemplary embodiments, it will be understood by those skilled in the art that various changes may be made and equivalents may be substituted without departing from the spirit and scope of the present disclosure. In addition, various modifications may be applied to adapt the teachings of the present disclosure to particular situations, applications, and/or materials, without departing from the essential scope thereof. The present disclosure is thus not limited to the particular examples disclosed herein, but includes all embodiments falling within the scope of the appended claims.

What is claimed is:

1. An elevator car constructed and arranged to move along a hoistway, the elevator car comprising:

a single cab;

a platform disposed below the cab;

a first vertical member extending upward from the platform;

a first flex joint connected to and extending between the platform and the first vertical member;

a crosshead member disposed above and extending over the cab; and a second flex joint connected to and extending between the first vertical member and the crosshead member.

2. The elevator car set forth in claim 1 further comprising:

a first guide device supported by the first vertical member for guiding the elevator car within the hoistway.

3. The elevator car set forth in claim 2, wherein the first guide device is at least one roller.

4. The elevator car set forth in claim 1 further comprising:

a second vertical member with the first vertical member disposed adjacent to a first side of the cab and the second vertical member disposed adjacent to an opposite second side of the cab; and a third flex joint connected to and extending between the platform and the second vertical member.

5. The elevator car set forth in claim 4 further comprising:

a fourth flex joint connected to and extending between the second vertical member and the crosshead member.

6. The elevator car set forth in claim 5 further comprising:

a first isolator connected to and extending between the platform and the cab;

a second isolator connected to and extending between the first vertical member and the cab; and a third isolator connected to and extending between the second vertical member and the cab.

7. The elevator car set forth in claim 6, wherein at least one of the first, second and third isolators is a spring.

8. The elevator car set forth in claim 6, wherein at least one of the first, second and third isolators is a resilient puck.

9. The elevator car set forth in claim 6, wherein the second and third isolators are proximate to a top of the cab.

10. The elevator car set forth in claim 6 further comprising:

a first guide device supported by the first vertical member for guiding the elevator car within the hoistway; and a second guide device supported by the second vertical member for guiding the elevator car within the hoistway.

11. The elevator car set forth in claim 5, wherein the flex joints have two degrees of freedom including a translational direction and a rotational direction.

12. The elevator car set forth in claim 11, wherein the translational direction and the rotational directions are orientated within a common imaginary plane.

13. The elevator car set forth in claim 11, wherein each flex joint includes at least one stopper for limiting translational motion and at least one snubber for limiting rotational motion.

14. An elevator car constructed and arranged to move along a hoistway, the elevator car comprising:

a cab;

a platform disposed below the cab;

a first vertical member extending upward from the platform;

a first flex joint connected to and extending between the platform and the first vertical member;

a crosshead member disposed above and extending over the cab;

a second flex joint connected to and extending between the first vertical member and the crosshead member;

a second vertical member with the first vertical member disposed adjacent to a first side of the cab and the second vertical member disposed adjacent to an opposite second side of the cab;

a third flex joint connected to and extending between the platform and the second vertical member;

a fourth flex joint connected to and extending between the second vertical member and the crosshead member;

a first isolator connected to and extending between the platform and the cab;

a second isolator connected to and extending between the first vertical member and the cab;

a third isolator connected to and extending between the second vertical member and the cab;

a first plurality of permanent magnets engaged to and distributed along the first vertical member for elevator car propulsion; and a second plurality of permanent magnets engaged to and distributed along the second vertical member for elevator car propulsion.

15. An elevator car constructed and arranged to move along a hoistway, the elevator car comprising:

a single cab;

a platform disposed below the cab;

a first vertical member extending upward from the platform; and a first flex joint connected to and extending between the platform and the first vertical member, wherein the first flex joint includes a casing engaged to one of the platform and the vertical member, a piston head arranged to reciprocate in a bore defined by the casing, and a shaft pivotally engaged between the piston head and the other of the platform and the vertical member.

16. A ropeless elevator system comprising:

an elevator car constructed and arranged to move along a hoistway, the elevator car including a cab, a platform disposed beneath the cab, a vertical member extending upward from the platform and a first flex joint engaged between the platform and the vertical member for flexing of the platform with respect to the vertical member; and a linear propulsion system directly carried between the hoistway and the vertical member for propelling the elevator car, wherein the first flex joint has a non-linear force profile.

17. The ropeless elevator system set forth in claim 16, wherein the elevator car includes a first isolator extending between the platform and the cab for attenuating energy.

18. The ropeless elevator system set forth in claim 17, wherein the elevator car includes a second isolator extending between the vertical member and the cab.

19. The ropeless elevator system set forth in claim 16, wherein the elevator car includes a cross head member extending over the cab, and a second flex joint engaged between the vertical member and the crosshead member.

* * * * *